United States Patent [19]

Kiefer

[11] 4,047,255

[45] Sept. 13, 1977

[54] FLOTATION HIKING HARNESS

[76] Inventor: James E. Kiefer, 2510 Lone Jack Road, Olivenhain, Calif. 92024

[21] Appl. No.: 682,891

[22] Filed: May 4, 1976

[51] Int. Cl.[2] ..... B63C 9/08

[52] U.S. Cl. ..... 9/337; 115/6.1

[58] Field of Search ..... 9/311, 329, 336–342, 9/330, 333, 334; 114/235 WS; 115/6.1; 244/151 R

[56] References Cited

U.S. PATENT DOCUMENTS

| | | | |
|---|---|---|---|
| 3,324,818 | 6/1967 | Dunlap | 115/6.1 |
| 3,360,813 | 1/1968 | Baker | 9/333 |
| 3,545,017 | 12/1970 | Cohn | 9/342 |
| 3,838,471 | 10/1974 | Brolli | 9/337 |

*Primary Examiner*—Trygve M. Blix
*Assistant Examiner*—Sherman D. Basinger
*Attorney, Agent, or Firm*—Robert E. Geauque

[57] ABSTRACT

A flotation hiking harness having back, side and crotch sections attached to a central buckle and having a shoulder section over the shoulder blades and front sections over the chest which terminate short of the bend line at the waist, the front and shoulder sections providing buoyancy and the front sections being fastened to the central buckle to assist in firmly securing the wearer to a tie line.

11 Claims, 6 Drawing Figures

FLOTATION HIKING HARNESS

BACKGROUND OF THE INVENTION

Trapeze or hiking harnesses are worn while sailing a sailboat in the manner called "hiking out" and are used for attaching a person to the boat by a line to the mast or other structure while the person is leaning out over the side of the boat to balance the boat while underway. This type of sailing can be done with single or multiple hull boats. It is possible to increase the speed of the boat since the weight of the person hanging over the side of the boat increases the resistance to the boat tipping over. Generally, the trapeze harness passes around the crotch and buttock of the wearer and fastens in the front to a buckle which is tied to the line attached to the boat. In some instances, straps have been attached to the back panel of the harness and extended up over the shoulders and down to the same buckle. While wearing a trapeze harness, the person is not protected with a flotation device and if the line to the boat were to break, the sailor would fall into the water and the harness would provide little or no flotation whatsoever.

It is a requirement that life saving vests approved by the U.S. Coast Guard be used on all boats over sixteen feet in length. There must be at least one U.S. Coast Guard approved life saving device on board for each person aboard the boat. Those who use a trapeze or hiking harness must also carry separate life vests aboard the boat and this is a real disadvantage for smaller boats, especially in competition, since storage space is almost nonexistant and, of course, the added weight and bulk are a problem. Life vests are usually too bulky and cumbersome to wear over the trapeze harness and for this reason sailors tend not to wear the two together. When a life vest is worn, it extends downwardly past the bend line at the waist and interferes with the activities of the wearer. As disclosed in U.S. Pat. No. 3,475,774, flotation has been applied to a parachute harness but such a device is not suitable to wear while engaged in sailing activities.

SUMMARY OF THE INVENTION

The present invention provides a trapeze harness having a back section and two front flotation sections tied to the back section over the shoulder so that the harness incorporates a flotation device and the harness will meet the requirements for a life-saving vest. The bottom portion of the harness has side sections passing around to the front of the wearer and has a crotch section passing between the legs of the wearer. A buckle located over the stomach of the wearer is connected to the side sections and the crotch section as in present harnesses. Also, the two front flotation sections are connected together over the chest of the wearer and a strap extends downwardly from one of the chest connections to the buckle. This later strap serves to hold the flotation sections down and against the body. The bottom edges of the front flotation sections are above the bend line of the waist of the wearer so as not to interfere with the bending of the body of the wearer at the waist during sailing. The connection of the two front flotation sections with the back is shaped to provide a maximum amount of opening for arm motion.

The thickness of the foam inserts in the front sections is considerably greater than that in the back sections so that the center of flotation is made to be in the front of the wearer and as high as possible to roll the person over and have his face out of the water. The invention provides a flotation hiking harness which consists of a complete life support system consisting of a sailing trapeze or hiking harness which is also a life-saving device for a person wearing the harness in typical precarious position out over the water. It is not necessary to carry other separate life vests aboard the vessel. The life-saving feature does not add excessive bulk to the harness and does not cause it to be cumbersome to wear.

BRIEF DESCRIPTION OF THE SHOWN EMBODIMENT

Figure 1:
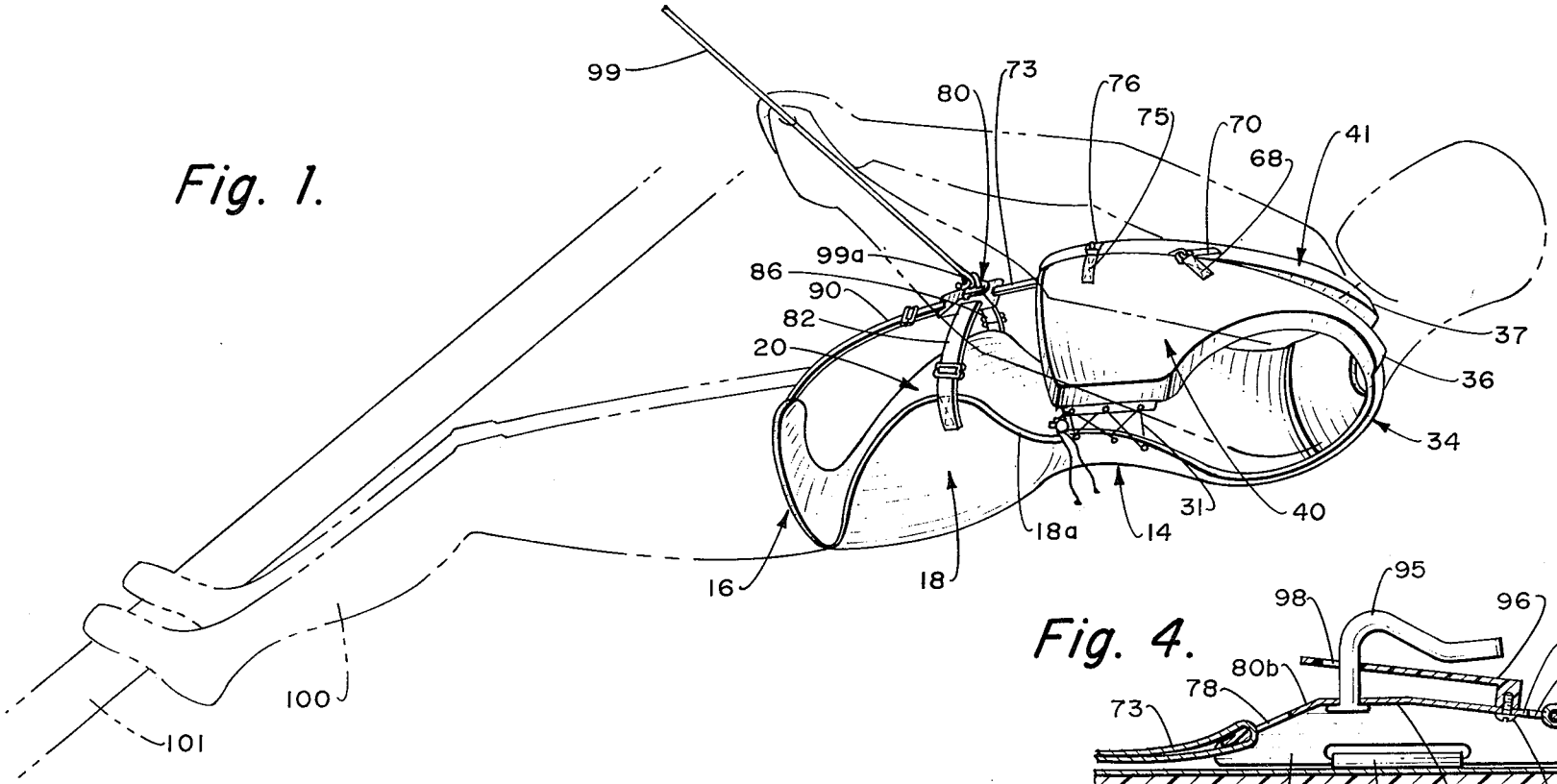
FIG. 1 is a perspective view of the flotation hiking harness showing the manner in which the harness is applied to the body of the wearer.
Figure 4:
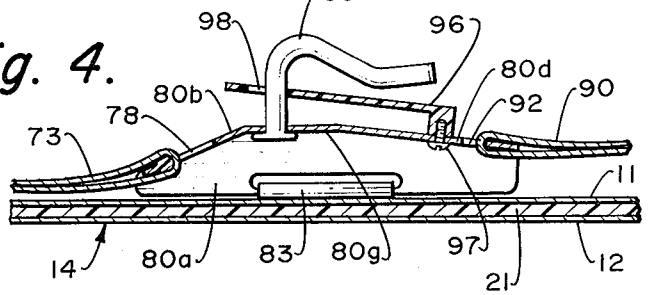
FIG. 4 is a vertical section along line 4—4 of FIG. 2 illustrating the buckle constructions.
Figure 3:
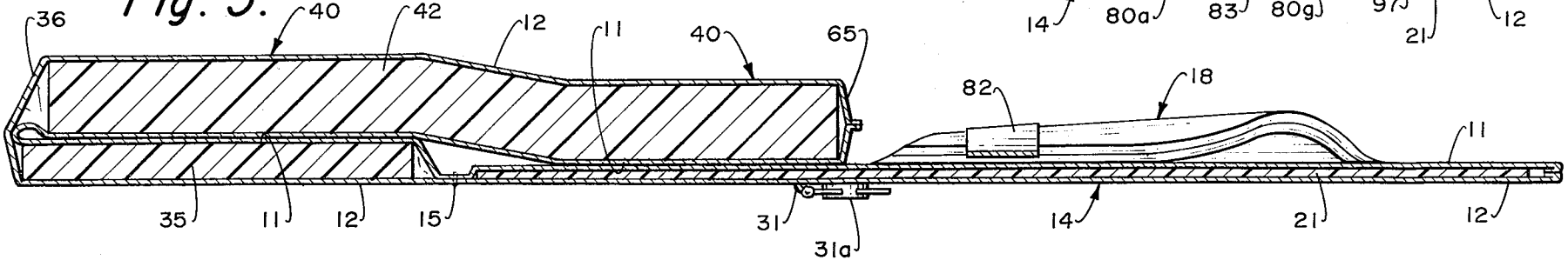
FIG. 3 is a vertical section along line 3—3 of FIG. 2.
Figure 2:
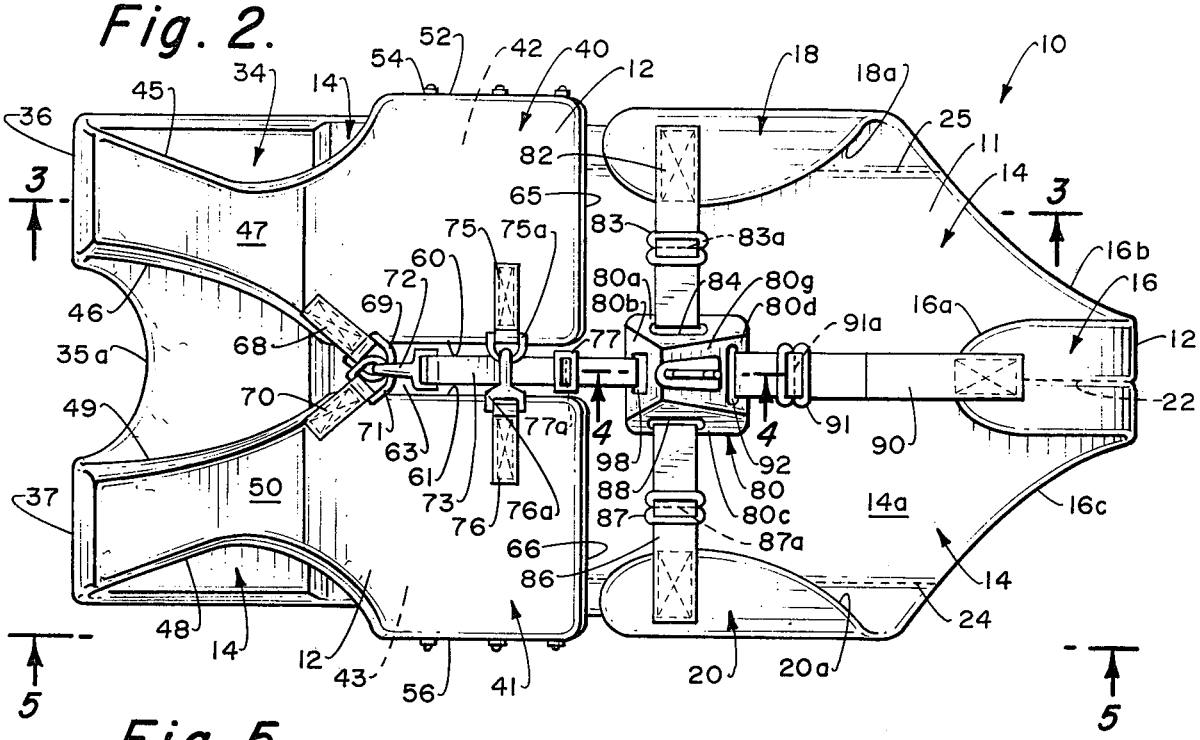
FIG. 2 is a top plan view of the present invention showing the central buckle to which the straps are attached.
Figure 5:
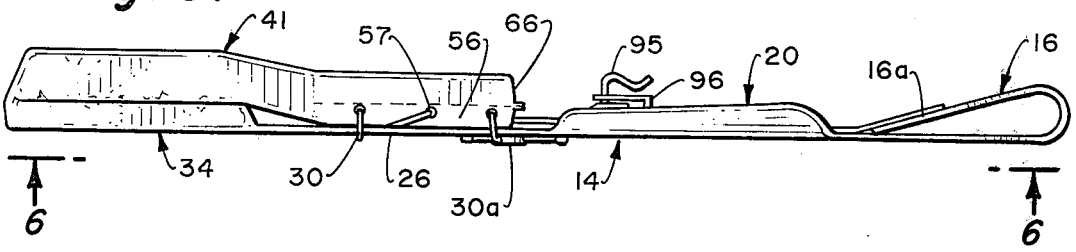
FIG. 5 is a side elevational view along line 5—5 of FIG. 2.
Figure 6:
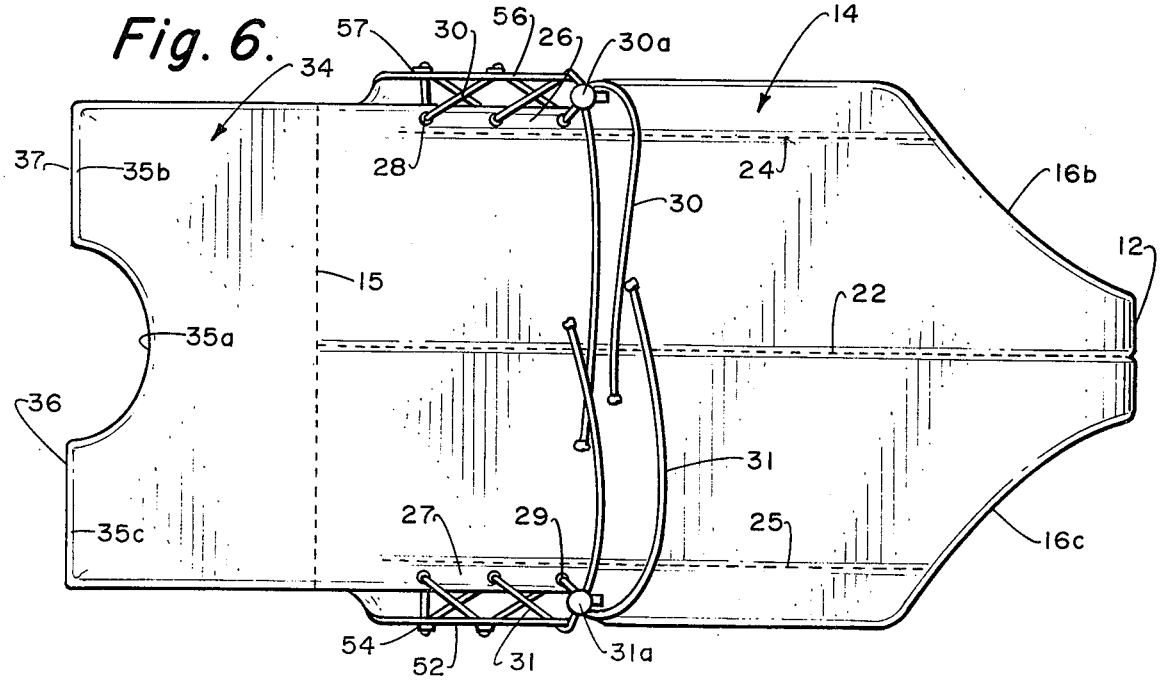
FIG. 6 is a back plan view showing the front flotation panels tied to the back panel.

Referring to FIGS. 2 and 6, flotation hiking harness 10 is fabricated of top layer 11 and bottom layer 12 of nylon cloth and the layers are continuous throughout the harness and are divided into different sections. Back section 14 extends from shoulder seam 15 to the end **16*a* of crotch strap section 16 (see FIG. 2). Side sections 18 and 20 extend from opposite sides of back section 14 and are defined by curved edges 18*a* and 20*a*, respectively, of the nylon layers. Side section 18 folds around one hip of the wearer's body because of the shape of the edge 18*a* and side section 20 folds around the other hip of the wearer's body because of the shape of the edge 20*a*. The crotch section 16 is narrowed by curved edges 16*b* and 16*c* so that it can pass between the legs of the wearer. The portion 14*a* of section 14 covers the buttock of the wearer. Between the nylon layers 11 and 12 forming these sections is placed panels of closed cell foam and the nylon layers are stitched together completely around these outside edges. Between the layers 11 and 12 in the back section 14 is a foam panel 21**, preferably of about one quarter inch thickness.

A central back seam 22 (see FIG. 6) extends from shoulder seam 15 to the end **16*a* of crotch 16 and serves to position the foam panel 21. Also, side seams 24 and 25 in back section 14 extend up to outside edge tie areas 26 and 27, respectively, which contains eyelets 28 and 29, respectively. Eyelets 28 are for receiving tie cord 30 and eyelets 29 receive tie cord 31. The nylon layers 11 and 12 above the shoulder seam line 15 form a shoulder section 34 containing polyvinyl foam layer 35 of approximately three quarter inch thickness. Neck cutout edge 35*a* in section 34 defines portion 35*b* and 35*c* extending to approximately the top of the shoulders. Over the shoulders beyond portions 35*b* and 35*c* at locations 36 and 37, respectively, there is no foam material between the nylon layers 11 and 12** so that the layers are free to flex over the shoulders.

Proceeding down over the front of the wearer, the nylon layers form two front sections 40 and 41 (see FIG. 2) receiving two separate front flotation panels 42 and 43, respectively, of closed cell foam, preferably each about one and onehalf inches thick and starting at the top of the shoulder. The front section 40 has outside edge 45 and inside edge 46 which curve towards each other to form a narrowed portion 47. Also, front section 41 has outside edge 48 and inside edge 49 which curve towards each other to form a narrowed portion 50. The edges 46 and 49 and cutout edge 35*a* define a neck opening and the edges 45 and 48 define, with the shoulder section, two arm openings. Straight outside edge 52 of front section 40 forms a tie area containing eyelets 54 receiving cord 31 and straight outside edge 56 of front section 41 forms a tie area containing eyelets 57 receiving cord 30. The outside lower straight edge portions 52 and 56 are somewhat less than half the total length of the respective front sections.

The straight inside edges 60 and 61 of front sections 40 and 41, respectively, are spaced apart to form a space 63 down the front of the wearer's body and the bottom, straight edges 65 and 66 of front sections 40 and 41, respectively, are above the waist bend line of the wearer. A strap 68 is stitched to nylon layer 12 for front section 40 and supports a loop 69 and a strap 70 is stitched to nylon layer 12 of front section 41 and supports a loop 71. The loops 69 and 71 are overlapped so that they can be both secured to snap 72 at the end of strap 73 which passes downward in space 63 over the wearer's stomach, for reasons to be described. Also, straps 75 and 76 are attached to opposed front section edges 60 and 61, respectively, and strap 75 carries a loop 75*a* and strap 76 carries a snap 76*a* for fastening the straps together.

A central buckle 80 is located approximately over the mid abdomen of the wearer and has slanted panels 80*a* to 80*d* which terminate in a top flat panel 80*g.* Center strap 73 extends through adjusting buckle 77 and through opening 78 in buckle panel 80*b* and the end is tied to center bar 77*a* of buckle 77 so that the length of straps 73 is adjustable. A strap 82 is fastened to nylon layer 12 of side section 18, passes through adjusting buckle 83 and slot 84 in panel 80*a,* and the end of the strap is fixed to the center cross rod 83*a* of buckle 83 so the movement of buckle 83 can adjust the length of the strap. In a similar manner, a strap 86 is attached to layer 12 of side section 20, passes through adjusting buckle 87 and slot 88 in panel 80*c,* and the end of the strap is fixed to the center crossbar 87*a* of buckle 87 so that the length of the strap 86 can be adjusted. Finally, a strap 90 is attached to layer 12 of crotch section 16 and extends through adjusting buckle 91 and through slot 92 in buckle panel 80*d.* The end of the strap is tied to center bar 91*a* of buckle 91. A metal hook 95 is welded to top panel 80*g* with the open side of the hook facing downward. A plastic line retainer 96 is secured to panel 80*d* by screw 97 and has a slot 98 so that it can move relative to the hook to receive and release the end 99*a* of line 99 which is tied to a structure portion of the boat.

With the line secured to hook 95, the feet 100 of the wearer can be braced against the top rail 101 of the boat and the wearer can extend outwardly over the edge of the boat and the weight of the wearer will be supported by the line. Straps 82 and 86 pull the side panels 18 and 20 tightly around the hips of the wearer and the harness is also retained on the wearer by the crotch strap 16 which is held in position by the strap 90. The straps 75 and 76 hold the front sections 40 and 41 against the body when fastened together as do straps 68 and 70 when fastened together with snap 72 of strap 73. Also, the tie cords 30 and 31 pass through the opposed tie down portions of the front sections and the back section 14 and are adjustable by fasteners 30*a* and 31*a* so that the back and front sections can be made to comfortably fit the wearer.

Strap 73 also serves to hold the front panels 40 and 41 down towards the buckle 80 and prevents the front panel from riding up over the shoulders of the wearer. The front sections 40 and 41 and the shoulder section 34 are connected together over the shoulders and serve both to support the body when hiking out and to provide flotation if the wearer should fall into the water. Straps 73 also serve to hold the vertical edges of the front section together as a supplement to the lower straps 75 and 76. Since lower edges 65 and 66 of the front section are higher than those of the standard life jacket and terminate above the bend line of the waist, the front sections do not interfere with the bending motion of the wearer during hiking as would a standard life jacket. Because of the narrowness of the portions 47 and 50 of the front sections, the arm openings are wide enough to permit active arm motion of the wearer without interference from the top portion of the jacket.

The foam panels 42 and 43 in the front sections are substantially thicker than the single foam panel 35 in the shoulder section, and the latter is substantially thicker than foam panel 21 in the lower back section 14. Also, the foam panels in the front sections are thicker than the front foam panels in standard life vests although the standard vest has longer panels. The foam thicknesses throughout the harness provides that the center of buoyancy will be in front of the wearer over the chest. In this location, the flotation moment is such that the person is turned over in the face-up mode and the center of buoyancy is as high as possible and in the front. While form panel 21 in back section 14 provides some buoyany, it is not sufficient to substantially effect the flotation action of the thicker foam panels higher up. It is understood that the thicknesses of the individual panels can be varied while still maintaining the desired flotation action.

What is claimed is:

1. A flotation hiking harness comprising:

buckle means located approximately over the mid abdomen of the wearer;

a continuous back panel section covering the back of the wearer and having a bottom portion covering the buttock, said back section extending at one end up to the shoulders of the wearer;

a crotch section connected to the other end of the back section and extending between the legs of the wearer;

a pair of side sections each connected to one side of said back section and extending over the hips of the wearer and terminating short of said buckle means;

a shoulder section connected with said one end of said back section and extending across the shoulders of the wearer;

a pair of continuous front panel sections each connected at its upper end to said shoulder section and extending side by side down over the chest of the wearer and terminating above said buckle means; and connecting means for connecting said buckle means to said crotch section, said side sections and said front sections.

2. A flotation hiking harness as defined in claim 1:

a first continuous layer over one surface of all said sections and a second continuous layer over the other surface of all said sections, said surface layers being connected together at their outside edges.

3. A flotation hiking harness as defined in claim 1:

the lower bottom end of each of said front sections being located above the waist bend line of the wearer.

4. A flotation hiking harness as defined in claim 1:

a neck cutout at one end of said shoulder section;

each front section having curved inside and outside edges extended from said shoulder connection, the inside curved edges on each front section opposite one another cooperating with said neck cutout to form a neck opening, the outside curved edges of each front section cooperating with said shoulder section to form arm openings.

5. A flotation hiking harness as defined in claim 4:

each of said front sections having a lower outside edge portion;

tie areas on each of said lower outside edge portions and on each outside edge of said back section; and adjustable tie means for connecting a tie area on a front section with a tie area on said back section.

6. A flotation hiking harness as defined in claim 1:

each of said front sections having a fastener means connected to its inside edge;

said connecting means comprising a strap connected between both said fastener means and said buckle means in order to hold said front sections in place over the front of the wearer when supported by a tie line fastened to said buckle means.

7. A flotation hiking harness as defined in claim 6:

each of said front sections having second fastener means connected to its inside edge adjacent the bottom edge of the front section, said second fastener means being connected together over said strap.

8. A flotation hiking harness as defined in claim 1:

each of said front sections comprising a panel of flotation material; and said shoulder section comprising a second panel of foam material thinner than said front section panels in order to place the center of buoyancy of said sections out in front of the wearer so as to turn the wearer over into the face-up position.

9. A flotation hiking harness as defined in claim 8:

a first continuous layer over one surface of all said sections and a second continuous layer over the other surface of all said sections, said surface layers being connected together at their outside edges, all of said panels being located between said surface layers.

10. A flotation hiking harness as defined in claim 8:

the bottom end of each of said front sections being located above the waist bend line of the wearer.

11. A flotation hiking harness as defined in claim 8:

said back section comprising a panel of flotation material thinnner than said second panel so as not to appreciably effect the location of said center of bouyancy.

* * * * *